US010102937B2

(12) United States Patent
Carpenter et al.

(10) Patent No.: US 10,102,937 B2
(45) Date of Patent: Oct. 16, 2018

(54) COLLIMATOR FOR PROVIDING CONSTANT COLLIMATION EFFECT

(71) Applicant: THE SECRETARY OF STATE FOR DEFENCE, Salisbury, Wiltshire (GB)

(72) Inventors: Morgan Gregory Carpenter, Salisbury (GB); Robert Michael Moss, Salisbury (GB)

(73) Assignee: The Secretary of State for Defence, Salisbury, Wiltshire (GB)

( * ) Notice: Subject to any disclaimer, the term of this patent is extended or adjusted under 35 U.S.C. 154(b) by 0 days.

(21) Appl. No.: 15/751,022

(22) PCT Filed: Aug. 24, 2016

(86) PCT No.: PCT/GB2016/000154
§ 371 (c)(1),
(2) Date: Feb. 7, 2018

(87) PCT Pub. No.: WO2017/037405
PCT Pub. Date: Mar. 9, 2017

(65) Prior Publication Data

US 2018/0233244 A1 Aug. 16, 2018

(30) Foreign Application Priority Data

Sep. 4, 2015 (GB) ..... 1515666.4

(51) Int. Cl.
*G21K 1/04* (2006.01)
*G21K 1/087* (2006.01)

(52) U.S. Cl.
CPC ..... *G21K 1/043* (2013.01); *G21K 1/087* (2013.01)

(58) Field of Classification Search
CPC G21K 1/02; G21K 1/025; G21K 1/04; G21K 1/043; G21K 1/087; G21K 5/00;
(Continued)

(56) References Cited

U.S. PATENT DOCUMENTS

2014/0010351 A1* 1/2014 Rommel ..... G21K 1/02 378/64

FOREIGN PATENT DOCUMENTS

CN 101195058 A 6/2008
EP 2124231 A2 * 11/2009 ..... G21K 1/02

OTHER PUBLICATIONS

Anonymous, "Football (ball)," Wikipedia, Aug. 12, 2015, XP055319767, https://en.wikipedia.org/w/index.php?title=Football_(ball)&oldid=675817639, 7 pages.

(Continued)

*Primary Examiner* — David E Smith
(74) *Attorney, Agent, or Firm* — Dean W. Russell; Kilpatrick Townsend & Stockton LLP

(57) ABSTRACT

A collimator taking the form of a prolate spheroid (40) comprising radiation attenuating material and featuring a twisted slit comprising radiation transmissive material. The twisted slit featuring first (43) and second (44) apertures arranged such that for each entrance point in one of the apertures there is a direct pathway through the major axis 'B' of the prolate spheroid (40), at a pre-determined angle, to a point in the other aperture, such that a compound aperture is formed. For each compound aperture the length of the direct pathway through the prolate spheroid (40) is constant. Rotation of the collimator about the major axis 'B', relative to a stationary point at the first aperture (43), steers in angle the compound aperture through the collimator from said stationary point. Such an arrangement allows radiation from a source positioned at said point to be collimated into a beam, the resultant beam being scanned in angle, and the resultant collimation effect being constant across the angular range of the scan.

6 Claims, 4 Drawing Sheets

(58) Field of Classification Search
CPC .... G21K 5/02; G21K 5/04; A61N 2005/1094; A61N 2005/1095
See application file for complete search history.

(56) References Cited

OTHER PUBLICATIONS

Anonymous, "Spheroid," Wikipedia, Aug. 19, 2015, XP055319765, https://en.wikipedia.org/w/index.php?title=Spheroid&oldid=676850346, 6 pages.
United Kingdom Patent Application No. GB 1515666.4, Search Report dated Apr. 1, 2016, 3 pages.
International Patent Application No. PCT/GB2016/000154, International Search Report and Written Opinion dated Nov. 28, 2016, 15 pages.
United Kingdom Patent Application No. GB 1614444.6, Combined Search and Examination Report dated Dec. 1, 2016, 5 pages.
International Patent Application No. PCT/GB2016/000154, International Preliminary Report on Patentability dated Mar. 15, 2018, 9 pages.

* cited by examiner

COLLIMATOR FOR PROVIDING CONSTANT COLLIMATION EFFECT

TECHNICAL FIELD OF THE INVENTION

The invention relates to the field of collimation, and more specifically to a collimator for providing constant collimation effect over a plurality of beam angles, combined with simplicity of design.

BACKGROUND TO THE INVENTION

Collimators are used in many applications in order to define the shape and alignment of radiation (which may be electromagnetic waves or beams of particles). For example it is possible to create two-dimensional fan-shaped beams of radiation or one-dimensional pencil beams of radiation using collimators. In particular applications of collimation, such as those using electromagnetic radiation in the visible or near visible spectrum, mirrors and lenses can be used to produce collimated beams. However for electromagnetic radiation with significantly shorter wavelengths and therefore higher energy (such as X-rays and Gamma-rays) or for radiation in the form of beams of particles, a collimator that acts as a filter to the radiation is required, such that only radiation travelling in desired directions is able to pass through the collimator unhindered.

Collimation is a necessity in many areas of physics and medicine where it is desirable to confine a divergent source of radiation into a useful, well-defined beam. Use of collimated beams of radiation enable a number of different analysis techniques to be performed and leads to improved resolution in some imaging applications, by minimising the amount of radiation that interacts with material that is not under test. Example applications where collimated beams of radiation may be required include X-ray and Gamma-ray radiography, radiation therapy and neutron imaging. Collimators may also be used to filter radiation from a scene, such that only radiation from a specific direction is allowed to pass through to, for instance, a detector. Further example applications where the ability to detect radiation from specific directions may be useful are Gamma-ray observations of space, and in the analysis of radioactive material.

Typically, a collimator for high energy electromagnetic radiation is made from a material of high atomic number such as tungsten or lead, and defines a number of apertures through which radiation can travel towards a target or detector. Radiation that is incident upon the body of the collimator is attenuated, so that only rays aligned with the apertures pass through unhindered.

A common problem with collimation techniques is that the flux at the target is greatly reduced as most of the source waves are blocked by the body of the collimator. This hinders imaging and analysis techniques by reducing performance and image clarity or by increasing the power of the source needed to attain the same image clarity at equal penetration. Furthermore, inconsistency in collimation effect (for instance with different beam angles) can further complicate imaging and analysis techniques.

Certain imaging applications such as x-ray backscatter, require the use of a scanning beam of radiation to build up a two-dimensional image of an object or field of view. A scanning beam can be achieved by introducing relative movement between the radiation source and the collimator in one dimension to produce a strip of image. If such one-dimensional scanning is combined with relative movement between the object and the source in an orthogonal direction, multiple one-dimensional strip images can be combined to form a two-dimensional image. It is known that to create a scanning pencil beam, a radiation source can be placed at the centre of a collimator in the form of a large rotating disc provided with radial apertures. As the disc rotates, a beam is emitted through each aperture and scanned across the field of view. However, such a disc is necessarily large and heavy. This affects the weight and portability of the whole equipment, requires significant power to maintain the correct rate of rotation and requires multiple moving parts, all of which increase the risk of equipment failure through breakage.

An alternative collimator design, disclosed in U.S.2014/0010351 (Rommel), utilises two parallel plates separated by a distance d. Each plate comprises a slot with the slots being arranged in a crossed arrangement to form an "X" or "+" shape. For radiation approaching from a given angle there is only a single compound aperture which passes through both slots, however as relative movement between the source and the collimator is introduced in one dimension, the single compound aperture "moves" in a lateral dimension. Therefore, by moving either the source or the collimator up and down, a laterally scanning beam can be created.

In the parallel plate collimator example, the path length through the compound aperture varies with displacement along the length of the apertures. This leads to a variation in the collimation effect and a variation in the size and shape of the beam exiting from the collimator, both of which have a negative impact on the quality of the final image. This latter problem is addressed in U.S.2014/0010351 (Rommel) by manipulating the shape of the slots. By increasing the width of the slots towards the edges of the block it is possible to maintain a constant beam cross-section area independent of the beam angle. However, the variance in path lengths remains, affecting the quality of collimation.

A further design of collimator is the solid cuboid twisted slit collimator. Such a collimator is illustrated in EP2124231 (BAM). For this collimator the path length through the compound aperture varies with displacement along the length of the slit, thereby resulting in variable collimation effect. Furthermore, in applications where a scanning beam of radiation is required, the solid cuboid twisted slit collimator needs to be rotated back-and-forth, rather than spun continuously, thus limiting achievable scanning speeds.

Therefore it is an aim of the invention to provide a collimator for providing constant collimation effect over a plurality of beam angles, combined with simplicity of design.

SUMMARY OF THE INVENTION

According to a first aspect of the invention there is provided a collimator for providing collimation of radiation from at least one radiation source, the collimator comprising radiation attenuating material and featuring a twisted slit comprising radiation transmissive material, wherein the twisted slit comprises first and second apertures configured to provide a series of compound apertures from a radiation entry point in one aperture to a radiation exit point in the other aperture, wherein the collimator substantially takes the form of a prolate spheroid body having a major axis that passes through its longest dimension, the first aperture extending at least partially around the body in a plane orthogonal to the major axis and the second aperture extending at least partially around the body in a spiral form relative to the major axis such that all direct pathways from an entry point to an exit point and passing through the major axis at a predetermined angle, are of constant length in order to provide constant collimation effect.

In accordance with a second aspect of the invention there is provided, a method of generating a scanning beam of radiation, the method comprising the steps of:

Providing a collimator in accordance with the first aspect of the invention;

Providing at least one divergent radiation source fixed stationary relative to the collimator and substantially positioned within the first aperture; and Rotating the collimator about the major axis such that the compound aperture through the collimator from the position of the at least one divergent radiation source, changes, thereby generating a scanning beam.

The term "radiation" is used in a broad sense to include energy in the form of waves or subatomic particles and is not limited to electromagnetic radiation. In some embodiments of the invention the collimator is used, to collimate radiation from a single divergent radiation source. In other embodiments of the invention the collimator is used to collimate radiation from a spatial source comprising, or approximated by, multiple divergent radiation sources.

The term "prolate spheroid" is used to describe a tri-axial ellipsoid with two equal semi-diameters (semi-axis a and semi-axis b). As a result the prolate spheroid has a circular cross section in any plane that is parallel to both semi-diameters. The third semi-axis of the prolate spheroid is longer than the two equal semi-diameters and is referred to as semi-axis c. The major axis in the context of the invention is the axis that passes through the longest dimension of the prolate spheroid (along semi-axis c). A particular example of a prolate spheroid is provided by the intersection between two overlapping equal sized circles being rotated about the axis passing through the points of intersection. A more particular example is provided when those equal sized circles each dissect the centre of the other. The invention provides a collimator substantially taking the form of a prolate spheroid. In some embodiments of the invention the collimator takes the form of a whole prolate spheroid. In other embodiments of the invention the collimator takes the form of part of a prolate spheroid, for example where the collimator must conform to a particular form factor.

The radiation attenuating material acts to reduce the energy of radiation incident upon it, or travelling through it. The attenuating material may be attenuating to specific forms of radiation. The attenuating material may be completely opaque to specific forms of radiation. As radiation passes into and through the attenuating material, energy may be lost such that the radiation does not pass completely through the material, or emerges from the material with sufficiently minimal energy such that it may be disregarded. The radiation attenuating material may comprise tungsten, for example.

Radiation that is incident upon radiation transmissive material is able to pass into and through the material unhindered. Unhindered is used to mean the radiation either does not interact with the radiation transmissive material, or interacts to a minimal degree such that the interaction can be ignored for the purposes of the invention. The radiation transmissive material may be air, or may comprise other suitable materials.

The twisted slit can be described as a pseudo-helix or spiral of a series of holes bored through a prolate spheroid structure. The holes each start at the circumference of the prolate spheroid—the circumference being the edge of the circular cross-section of the prolate spheroid in the plane containing 'semi-axis a' and 'semi-axis b' (also referred to as the xy plane). The holes boring though at some angle $\phi$ to the horizontal xy plane with some angle $\theta$ about the vertical axis in the horizontal xy plane—an angle relative to the direction of the first hole. The first hole has angles $\phi_0=+\phi_{max}$ and $\theta_0=0$; each successive hole has angles: $\phi_n=\phi_{n-1}+d\phi$ to the limit of $\phi_n=-\phi_{max}$ and $\theta_n=\theta_{n-1}+d\theta$ to the limit of $\theta_n=2\pi-d\theta$. In accordance with the invention the collimator comprises radiation attenuating material and features a twisted slit. The term 'first aperture' refers to the gap in the radiation attenuating material produced at the circumference as a result of the holes bored through the prolate spheroid. The term 'second aperture' refers to the gap in the radiation attenuating material that spirals around the prolate spheroid about the major axis, produced as a result of the holes bored through the radiation attenuating material at predetermined angles, exiting the prolate spheroid. The first and second apertures extend substantially around the prolate spheroid. In some embodiments the apertures do not extend completely around the prolate spheroid for structural stability reasons. In embodiments where the radiation transmissive material filling the twisted slit comprises a solid material, the apertures may extend completely around the prolate spheroid.

The term compound aperture is used to describe an aperture through the collimator provided as a result of the arrangement of the first and second apertures forming the twisted slit. For each point in the first aperture, there is a direct pathway through the major axis of the prolate spheroid, at a predetermined angle, to a point in the second aperture, thereby creating a compound aperture. The direct paths transit through the radiation transmissive material.

By ensuring that all path lengths through the collimator—from an entry point in the first aperture to an exit point in the second aperture—are the same length, it is possible to form a collimated beam having constant cross-section, and constant collimation effect, irrespective of the compound aperture through which radiation has transited. This is not achieved by cuboid, cylindrical or spherical collimators.

The collimator may be configured to rotate about at least the major axis. The rotation may be continuous at fixed or variable rates. In an embodiment of the invention, one divergent radiation source is provided and fixed stationary relative to the collimator, such that when the collimator is rotated about the major axis, the compound aperture for radiation from the divergent source, moves, and a continuously scanning beam of radiation is generated. This is advantageous over back-and-forth rotation because the mechanism required to maintain constant speed can be less complex and higher speeds can be achieved. Alternatively, in embodiments where it is necessary to steer a beam of radiation in a non-continuous fashion, the collimator may be configured to rotate to specific positions and dwell at those positions. Furthermore, the collimator may be configured such that it can be rotated about a secondary axis. The secondary axis may be orthogonal to the major axis such that combinations of rotations about both axes will allow a beam of radiation to be steered or scanned in two dimensions. In an embodiment of the invention, the collimator is rotated such that the projection of the compound aperture is steered or scanned across a spatial radiation source. In this embodiment only radiation originating from a particular position on the spatial source is able to pass through each projection of the compound aperture. The radiation passing through the compound aperture may then be detected.

The collimator may incorporate within the first aperture a recess which completely circumnavigates the body, suitable for confining at least one radiation source or detector. The recess may continue beyond the extent of the aperture itself. It may be particularly desirable for the radiation source to sit within the outer surface of the collimator if it is a divergent source, to enable the divergent radiation to pass directly through the apertures at all angles from the lowest aperture angle, $-\phi_{max}$, to the highest aperture angle, $+\phi_{max}$. Further, the more enclosed source requires less additional shielding to prevent unwanted radiation leakage. In practical applications such as X-ray backscatter imaging, the radiation source may be an anode target upon which electrons are incident, and from which X-rays are generated and are subsequently collimated. In a similar manner it may be desirable for the detector to sit within the outer surface of the collimator in embodiments where the collimator is being used to scan a scene across a plurality of angles for radiation.

In an embodiment of the invention, in particular one in which a divergent radiation source is mounted in a fixed position relative to the collimator and located within the recess of the first aperture, and one in which the collimator is rotated at a constant speed, a beam of radiation can be scanned across a field of view in a direction parallel to the axis of rotation. The solid angle scanned by the collimator can be up to 120° and the spot size and shape are maintained constant through the entire angular range.

The drawings are for illustrative purposes only and are not to scale.

DETAILED DESCRIPTION

Figure 1:
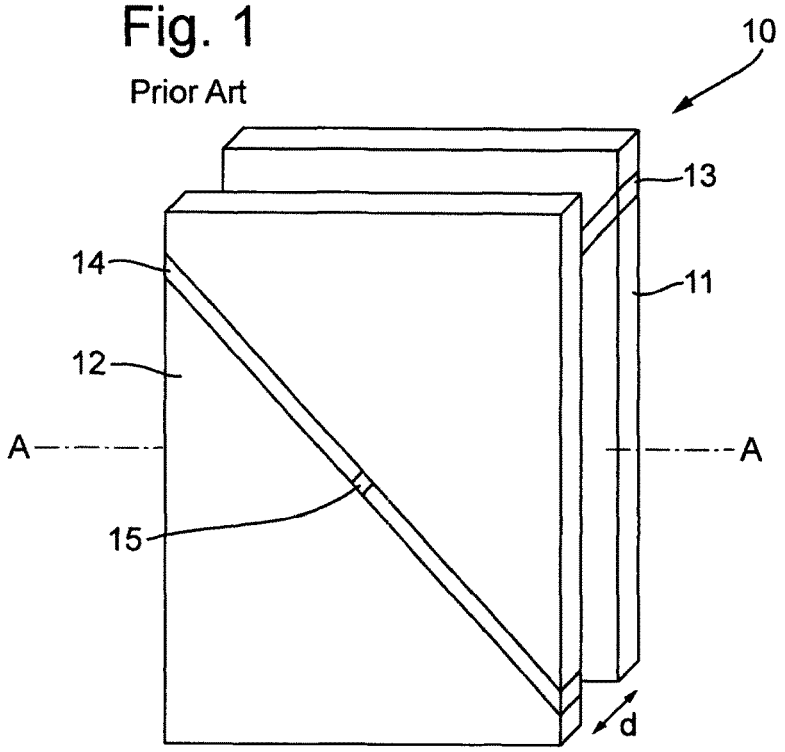
Fig. 1 Prior Art
FIG. 1 shows a parallel plate collimator in accordance with the prior art.

FIG. 1 illustrates a parallel plate collimator 10 in accordance with U.S.2014/0010351 (Rommel). Plates 11, 12 are arranged parallel to each other and separated by a distance d. The plates 11, 12 are made from a material which is opaque to the radiation to be collimated and are provided with elongate apertures 13, 14 which are transparent to the radiation to be collimated. The apertures 13, 14 are arranged in the form of an "X" such that for radiation approaching from a given angle there is only a single compound aperture 15 which allows radiation to pass through both plates 11, 12. Therefore, a single collimated beam of radiation passes through the collimator 10.

As the collimator 10 is rotated up and down about a horizontal axis 'A' the position of the compound aperture 15 moves from side to side relative to a fixed source of radiation (not shown). The effect is that a collimated beam of radiation is scanned laterally across a field of view.

The same effect is achieved by moving the radiation source up and down relative to a fixed collimator.

Figure 2:
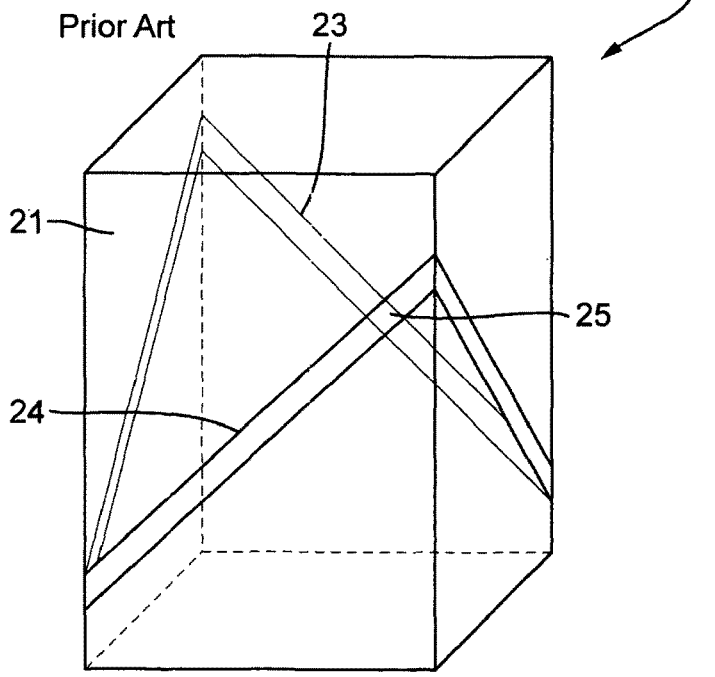
Fig. 2 Prior Art
FIG. 2 shows a solid cuboid collimator in accordance with the prior art.

FIG. 2 illustrates a solid cuboid collimator 20 in accordance with EP2124231 (BAM). The body of the collimator 21 is made from a material which is opaque to the radiation to be collimated and is provided with elongate apertures 23, 24 which are transparent to the radiation to be collimated. The apertures 23, 24 are arranged in the form of an "X" such that for radiation approaching from a given angle there is only a single compound aperture 25 which allows radiation to pass through the collimator 20.

The apertures 23, 24 are joined by two hyperbolic paraboloid surfaces which pass through the collimator and define the volume to which radiation is confined by the collimator. This is referred to as the twisted slit.

Examples of solid cuboid collimators that would operate at visible wavelengths were modeled by the inventor and 3D printed as optical proxies for x-ray collimators. Four versions were tested using the experimental setup shown in FIG. 3. A tri-axis "Zaber Motorised Stage" 31 was used to move a light source (LED) 32 sequentially about a volume behind the collimator 33, whilst a webcam 34 recorded and collated images of the emitted light at each point, as viewed on a paper image screen 35 protected by light shields 36, 37. The collimators which gave largest fields of view were those where the angle between the first and second aperture were greatest.

The concept of the solid cuboid twisted slit collimators being used to steer a beam in one axis by rotating about an opposing axis has been proven to work by the inventor. However, they have limitations in that the path length—and thus the collimation effect—varies with the displacement along the length of the slit. This causes a change in the size and shape of the beam which would have a negative impact on the final image. Another issue with the cuboid collimator is its inability to be spun continuously and keep the spot "flying;". The collimator would need to be spun back-and-forth in order to achieve this effect, reducing the speed it could be rotated at and further limiting its use as, for instance, a replacement for current X-ray back-scatter flywheel designs. A solution to both of these issues is to curve the apertures around the surface of a specially formed prolate spheroid, where the first aperture is orthogonal to the axis of rotation (in this example the major axis) and the second aperture (the one which emits the collimated beam) extends partially around the body in a spiral form such that all direct path lengths through a compound aperture of the first and second apertures (from an entry point in the first aperture, passing through the major axis at a predetermined angle, to an exit point in the second aperture), are of constant length.

Figure 4:
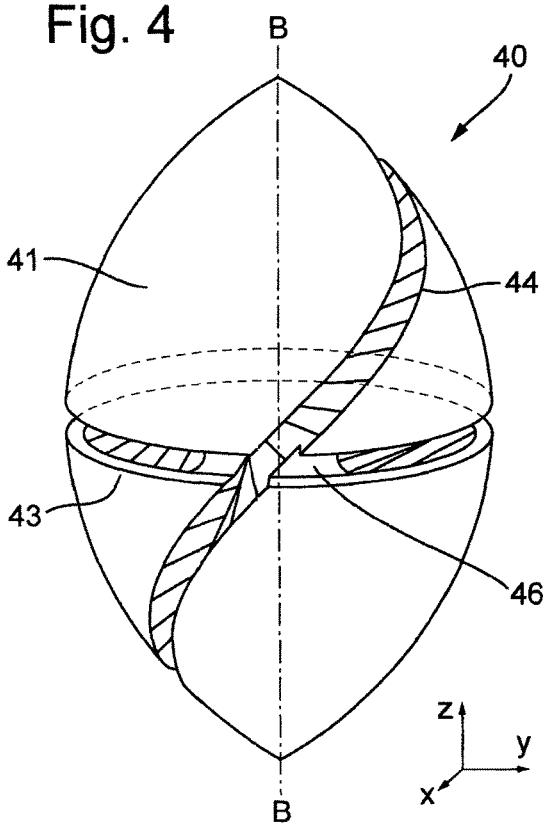
FIG. 4 illustrates a collimator in accordance with the invention.

FIG. 4 illustrates a prolate spheroid adaptation 40 of the solid cuboid twisted slit collimator 20, having a first aperture 43 and a second aperture 44. The primary objective was to define the form of the twisted slit and hence the apertures 43, 44 relative to the axis of rotation B (the major axis), with the external body shape 41 being consequential rather than the driving factor. Whilst the first aperture 43, in this embodiment, does not extend all the way around the collimator body, in order to maintain the integrity of the solid body, a relatively shallow recess 46 is provided between the ends of the aperture 43 to provide a continuous recess which circumnavigates the body. This allows for the collimator 40 to be continuously rotated about major axis B whilst a radiation source (not shown) is fixedly positioned within the confines of the recess 46.

To create the body shape in FIG. 4, first the twisted slit was developed relative to an axis of rotation (in this example, the major axis). The twisted slit was created in MATLAB® as a set of lines with start and end points of (0, y) and ($+n_x$, y) respectively, where y goes in incremental steps between $-n_y$ and $+n_y$. These lines were rotated about the y-axis, to define the angle of rotation as a function of the line's position along the y-axis.

This ensured the paths were kept at the same length, correcting the issue of relying upon the surface of the outer shape (cuboid or sphere) to dictate this length. These equal paths which would run around the undefined surface of the structure were then translated so their start points were at the origin; rotated about the z-axis using spherical polar matrix operations to wrap them around a circular circumference; before being translated again to a separation of the initial path length.

Figure 5B:
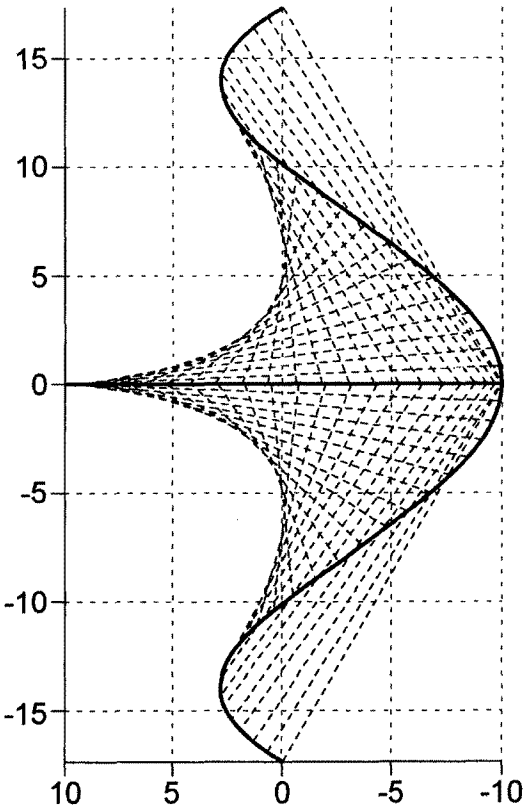
FIG. 5*a* and FIG. 5*b* illustrate the design process for defining the twisted slit in a collimator in accordance with the invention.
Figure 5A:
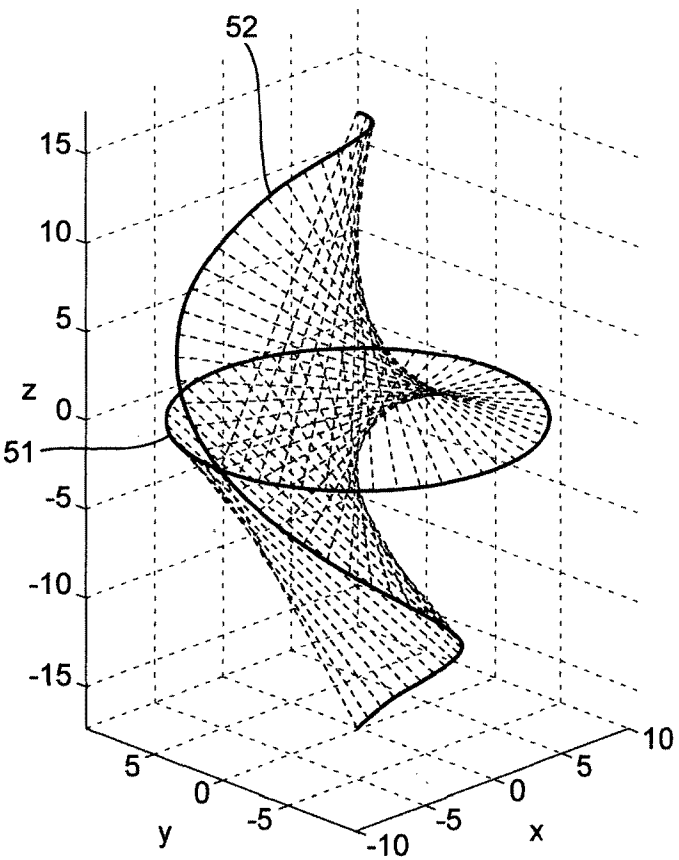

FIG. 5*a* and FIG. 5*b* show the basic surface structure created from these transformed and translated paths from two different views and illustrates how the twisted slit can be described as a pseudo-helix of an infinite number of holes bored through a solid prolate spheroid structure. The holes each start at the circumference of the prolate spheroid 51 in the plane containing the two equal semi-diameters, boring though at some angle $\phi$ to the horizontal xy plane with some angle $\theta$ about their start points in the horizontal xy plane—an angle relative to the direction of the first hole. The first hole has angles $\phi_0=+\phi_{max}$ and $\theta_0=0$; each successive hole has angles: $\phi_n=\phi_{n-1}+d\phi$ to the limit of $\phi_n=-\phi_{max}$ and $\theta_n=\theta_{n-1}+d\theta$ to the limit of $\theta_n=2\pi-d\theta$, where $d\theta$ and $d\phi$ are infinitesimal angle steps.

The equations governing the cartesian (x,y,z) end-points 52 of the slit are detailed in Equations 1-3. These are joined to respective points on the circumference in the x-y plane, given by a simple circle equation in x and y.

$$x(\rho, \phi, \theta)=\rho \sin \phi \cos \theta \quad \text{[Equ. 1]}$$

$$y(\rho, \phi, \theta)=\rho \sin \phi \sin \theta \quad \text{[Equ. 2]}$$

$$z(\rho, \theta)=\rho \cos \theta \quad \text{[Equ. 3]}$$

Where:

$$\rho = \text{length of hole}$$

$$\phi = \left[\frac{\pi}{6}:n:\frac{5\pi}{6}\right]$$

$$\theta = [0:n:2\pi]$$

The code, produced in MATLAB®, gave the start and end points of a series of beam-lines passing through a solid body defined by joining these same points; expanding these to have radii as well as length gave a simplified representation of the solid surface which could be used to produce the 3-D computer aided design (CAD) model. The resultant start and end points form two distinct apertures on the surface of a prolate spheroid. The radii of each beam line, which gives rise to the width of the final twisted slit, can be varied to suit the degree of collimation required.

The inventor has determined that in an embodiment of the invention, the collimator may be used to scan a collimated beam of radiation over a solid angle of 120°; full parameter details can be found in Table 1.

Parameters in the table are: pathLength, which is the diameter of the prolate spheroid from each point on the circumference to the opposite point on the surface ie the width of material radiation is collimated through; numberOfPaths which is the number of start and end points for (ultimately) the cylindrical holes; numberOfSpheroidRings defined how many points were used to create the body surface, although the final surface was significantly decimated to reduce computational time; greatestBeamAngle was used to define the maximum and minimum angle from the x-y plane of the paths; whilst Opening Diameter is the diameter of the paths through the solid.

Figure 3:
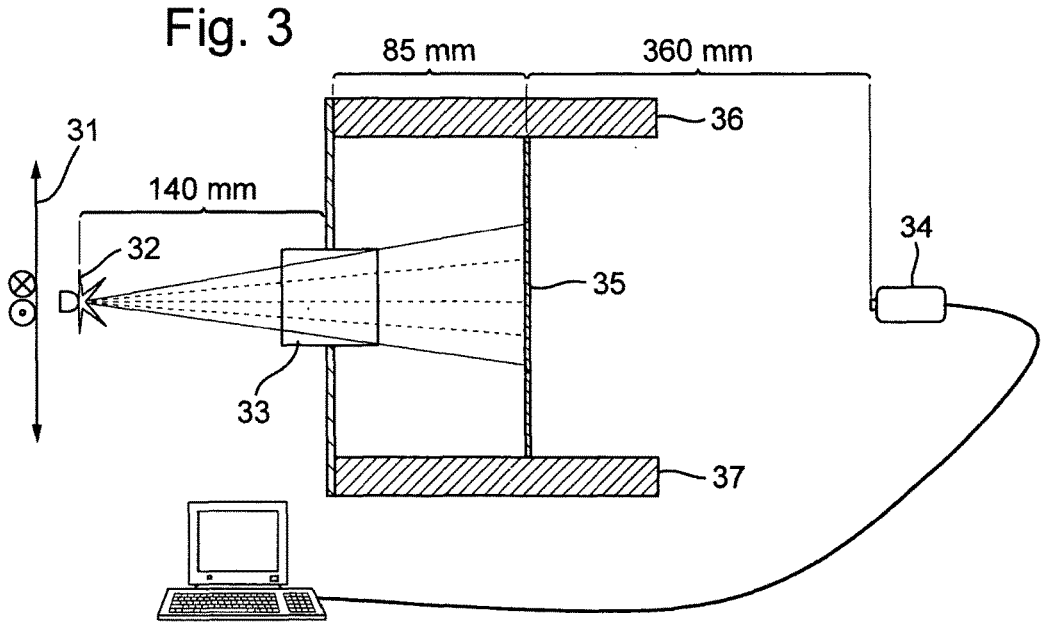
FIG. 3 shows a schematic of an experimental arrangement used for testing collimator field of view.

The same experimental setup shown in FIG. 3 was used to determine the FoV for a scanning beam embodiment of the collimator except that in this case the collimator 33 was placed on a rotational stage with the LED 32 being fixed.

Figure 6:
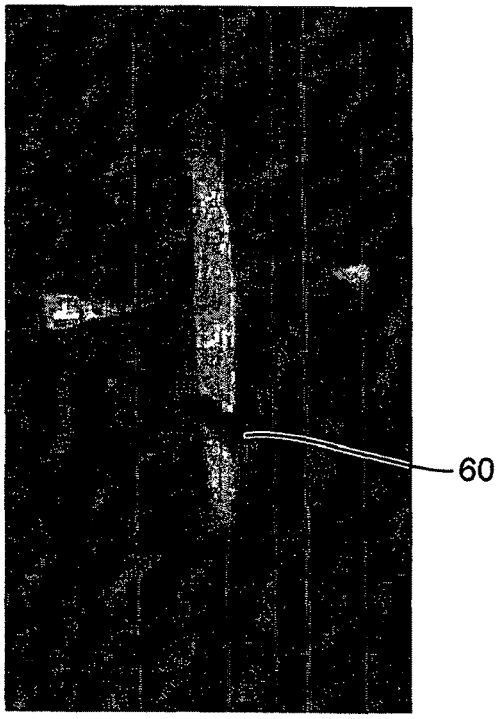
FIG. 6 shows an image of a spot of radiation produced by a visible beam of radiation collimated in accordance with the invention.

The FoV given by the scanning beam embodiment of the collimator at ~170 mm from the vertical axis of the collimator was (500+/−10)mm, an image of which can be seen in FIG. 6. This is an order of magnitude larger than the equivalent FoV for the solid cuboid twisted slit collimators. The dark patch 60 is an artefact of the experimental setup chosen for testing an embodiment of the collimator.

Figure 7:
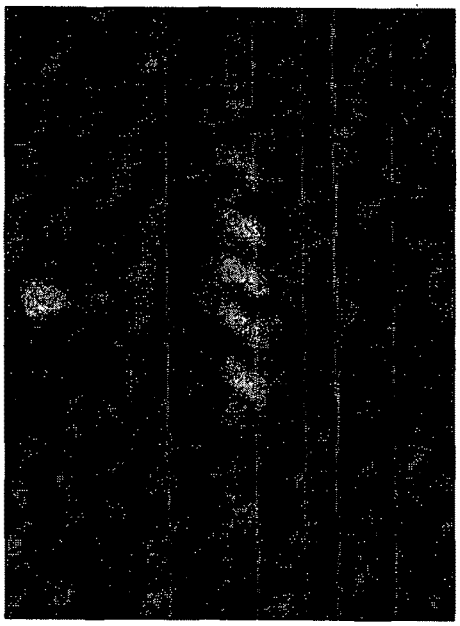
FIG. 7 shows a set of superimposed still images of spots of radiation produced by visible beams of radiation collimated in accordance with the invention, each spot representing a collimated beam at a different angle.

FIG. 7 shows a set of superimposed still images illustrating that the size and shape of the spot produced by the scanning beam collimator is a constant, differing only slightly from the maximum angle to the minimum angle. This is beneficial to imaging applications such as X-ray back scatter since it would give a more uniform illumination across the image, reducing the distortion.

The two spots of light which can be seen in FIGS. 6 and 7 either side of the main beam FoV are from the light passing round the edges of the inner surface at the circumference. The spots are in a constant position so could be removed in a final system either through image processing or with small additional collimation.

Whilst an optical collimator has been described it will be apparent to the skilled person that a collimator for use with other types of radiation would be manufactured from other materials and by other manufacturing techniques. For example the 3-D model could be used to create a plastic mould into which a powdered tungsten alloy could be cast, removing the need for the complex machining of expensive, solid tungsten blocks. The prolate spheroid shape can be scaled as required to suit the application.

By way of an example, assuming a circumference diameter of 50 mm, the moment of inertia for a tungsten scanning beam collimator rotating in front of the source is a factor of ~100 less than a copper fly-wheel spinning around the source. This would reduce the torque needed and hence reduce power consumption by ~16%. The calculations don't take into account resistive angular momentum of the spinning disk which could improve this power-reduction further.

The invention claimed is:

1. A collimator for providing collimation of radiation from at least one radiation source, the collimator comprising radiation attenuating material and featuring a twisted slit comprising radiation transmissive material, wherein the twisted slit comprises first and second apertures configured

| Filename - SBC | pathLength (mm) | numberOfPaths | numberOfSpheroidRings | greatestBeamAngle | Opening Diameter |
|---|---|---|---|---|---|
| CompletedSpheroidColimator_2.0.stl | 100 | 60 | 15 | 30 | 10 |

Table 1: A table giving the initial parameters for a collimator, as used in the MATLAB® code, which generated the start and end points for the model.

to provide a series of compound apertures from a radiation entry point in one aperture to a radiation exit point in the other aperture, wherein the collimator substantially takes the form of a prolate spheroid body having a major axis that passes through its longest dimension, the first aperture extending at least partially around the body in a plane orthogonal to the major axis and the second aperture extending at least partially around the body in a spiral form relative to the major axis such that all direct pathways from an entry point to an exit point and passing through the major axis at a predetermined angle, are of constant length in order to provide constant collimation effect.

2. A collimator according to claim 1 configured to rotate about the major axis.

3. A collimator according to claim 1 wherein the first aperture incorporates a recess which completely circumnavigates the body, the recess suitable for confining at least one radiation source or detector.

4. A collimator according to claim 1 wherein the radiation transmissive material comprises air.

5. A collimator according to claim 1 wherein the radiation attenuating material comprises tungsten.

6. A method of generating a scanning beam of radiation, the method comprising the steps of:

providing a collimator in accordance with claim 1;

providing at least one divergent radiation source fixed stationary relative to the collimator and substantially positioned within the first aperture; and rotating the collimator about the major axis such that the compound aperture through the collimator from the position of the at least one divergent radiation source, changes, thereby generating a scanning beam.

* * * * *